US006909367B1

(12) United States Patent
Wetmore

(10) Patent No.: US 6,909,367 B1
(45) Date of Patent: Jun. 21, 2005

(54) METHOD OF DETERMINING THE EXACT LOCATION OF AN INDIVIDUAL IN A STRUCTURE

(76) Inventor: Larry P. Wetmore, 10905 32nd Ave., Pleasant Prairie, WI (US) 53158

( * ) Notice: Subject to any disclaimer, the term of this patent is extended or adjusted under 35 U.S.C. 154(b) by 143 days.

(21) Appl. No.: 10/373,241

(22) Filed: Feb. 24, 2003

(51) Int. Cl.[7] ..... G08B 1/08

(52) U.S. Cl. ..... 340/539.21; 340/539.11; 340/539.13; 340/825.49

(58) Field of Search ..... 340/539.21, 573.1, 340/539.11, 539.27, 539.13, 825.36, 825.49; 342/463, 465

(56) References Cited

U.S. PATENT DOCUMENTS 5,458,123 A 10/1995 Unger ..... 128/696
5,883,598 A * 3/1999 Parl et al. ..... 342/457
5,917,425 A 6/1999 Crimmins et al. ..... 340/825.49
6,348,867 B1 * 2/2002 Myllymaki ..... 340/573.1
6,396,413 B2 * 5/2002 Hines et al. ..... 340/825.49
6,539,393 B1 * 3/2003 Kabala ..... 707/102

* cited by examiner

*Primary Examiner*—Toan N. Pham
(74) *Attorney, Agent, or Firm*—Donald J. Ersler

(57) ABSTRACT

A method of determining the exact location of an individual in a structure includes at least one transmitter unit, at least three receiver units and a central processing unit (CPU). A single transmitter unit is attached to each individual in the structure. If it is desired to control temperature adjacent the individual, a temperature sensor is also included in the transmitter unit. A panic button signal may also be included as one of the transmitter outputs. The CPU receives data from the at least three receivers and determines the location of each individual in the structure and whether the area they are in requires temperature modification. The CPU is preferably capable of opening and closing motorized drapes or operating lighting according to a time schedule. A panic button may be included in the transmitter and the controller programmed to seek assistance.

19 Claims, 5 Drawing Sheets

METHOD OF DETERMINING THE EXACT LOCATION OF AN INDIVIDUAL IN A STRUCTURE

BACKGROUND OF THE INVENTION

1. Field of the Invention

The present invention relates generally to tracking the location of an individual and more specifically to a method of determining the exact location of an individual in a structure to control temperature in the structure.

2. Discussion of the Prior Art

The prior art teaches numerous ways of tracking an individual in a structure. U.S. Pat. No. 5,458,123 to Unger discloses a system for monitoring patient location and data. Unger teaches wearing a transmitter to monitor vital signs of a patient. The patient's location is determined by using at least three antennas. U.S. Pat. No. 5,917,425 to Crimmins et al. discloses an IR/RF locator. Crimmins et al. teaches a plurality of stationary units distributed in zones through an enclosure. The article or person carries a portable device so that the infrared communication link can derive location information of the article or person. However, neither of the above patents teaches or suggests using relative signal strength to triangulate the location of a specific individual in a structure.

Accordingly, there is a clearly felt need in the art for a method of determining the exact location of an individual in a structure for controlling temperature adjacent the individual; controlling temperature in other areas of the structure; reducing the cost of energy; and improving comfort.

SUMMARY OF THE INVENTION

The present invention provides a method of determining the exact location of an individual in a structure to control temperature and other functions in the structure. The method of determining the exact location of an individual in a structure (method of determining location) includes at least one transmitter unit, at least three receiver units and a central processing unit (CPU). A single transmitter unit is attached to each individual in the structure. The at least three receiver units are preferably arranged inside the structure in a triangular configuration. At least three receiver units are required for each transmitter unit. Each receiver unit provides a received signal strength output. If it is desired to control temperature adjacent the individual, a temperature signal output is also included in the transmitter unit. A panic button signal may also be included as one of the transmitter outputs.

The CPU preferably includes a controller, at least one input device and an input/output board (I/O board). The at least one input device is preferably a keyboard and/or a mouse. The I/O board receives data from the at least three receiver units. The I/O board includes a plurality of analog-to-digital converters (A/D converters) and data buffering. The received signal strength outputs from the at least three receiver units are converted from analog signals into digital received strength signals by the plurality of A/D converters. The digital received strength signals, the temperature signals and the panic signals are buffered by the I/O board. The I/O board is connected to the input pins of the controller and the output pins of the controller are preferably connected to the I/O board.

The controller is preferably a computer, but other microprocessor or microcontroller based devices may also be used. The controller inputs the data received from the I/O board and determines the location of each individual in the structure and whether the area they are in requires temperature modification. If an individual is not in an area, the temperature may be modified to provide a nonoccupied temperature. The controller will also provide a temperature, if more than one individual is in the same area. If temperature modification is required, the controller will send control signals through the I/O board to control the operation of a furnace or air conditioner and motorized dampers in vents and ducts. The controller may be programmed to open and close motorized drapes or to operate lighting according to a time schedule. The controller may also be used to turn on audio or video for a specific individual. A panic button may be included in the transmitter and the controller programmed to seek assistance.

Accordingly, it is an object of the present invention to provide a method of determining location, which provides improved comfort.

It is a further object of the present invention to provide a method of determining location, which reduces the cost of energy.

Finally, it is another object of the present invention to provide a method of determining location, which may be used to control other functions, such as lighting, audio, video and security.

These and additional objects, advantages, features and benefits of the present invention will become apparent from the following specification.

DETAILED DESCRIPTION OF THE PREFERRED EMBODIMENTS

Figure 1:
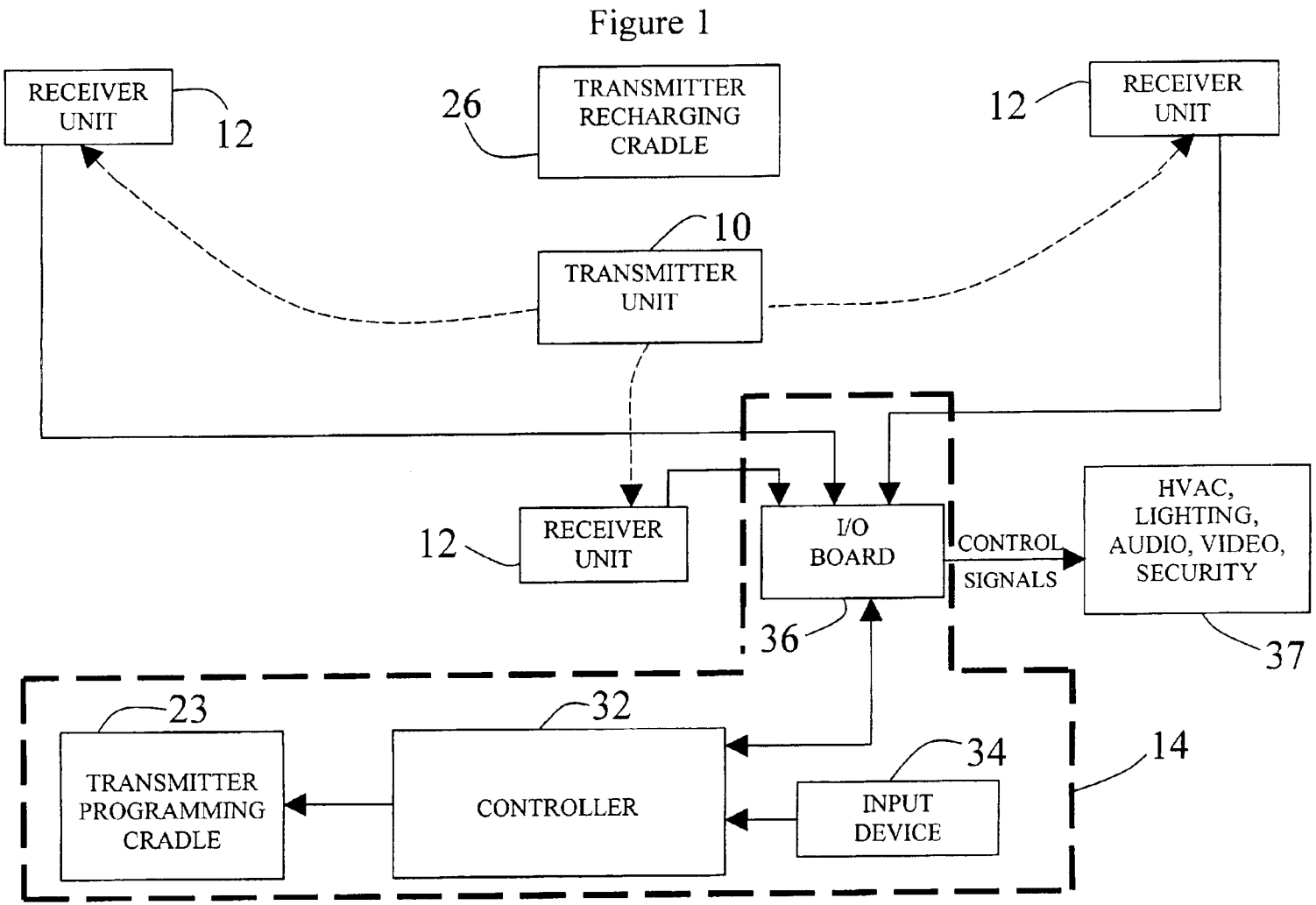
FIG. 1 is a system block diagram of a method of determining location in accordance with the present invention.
Figure 2:
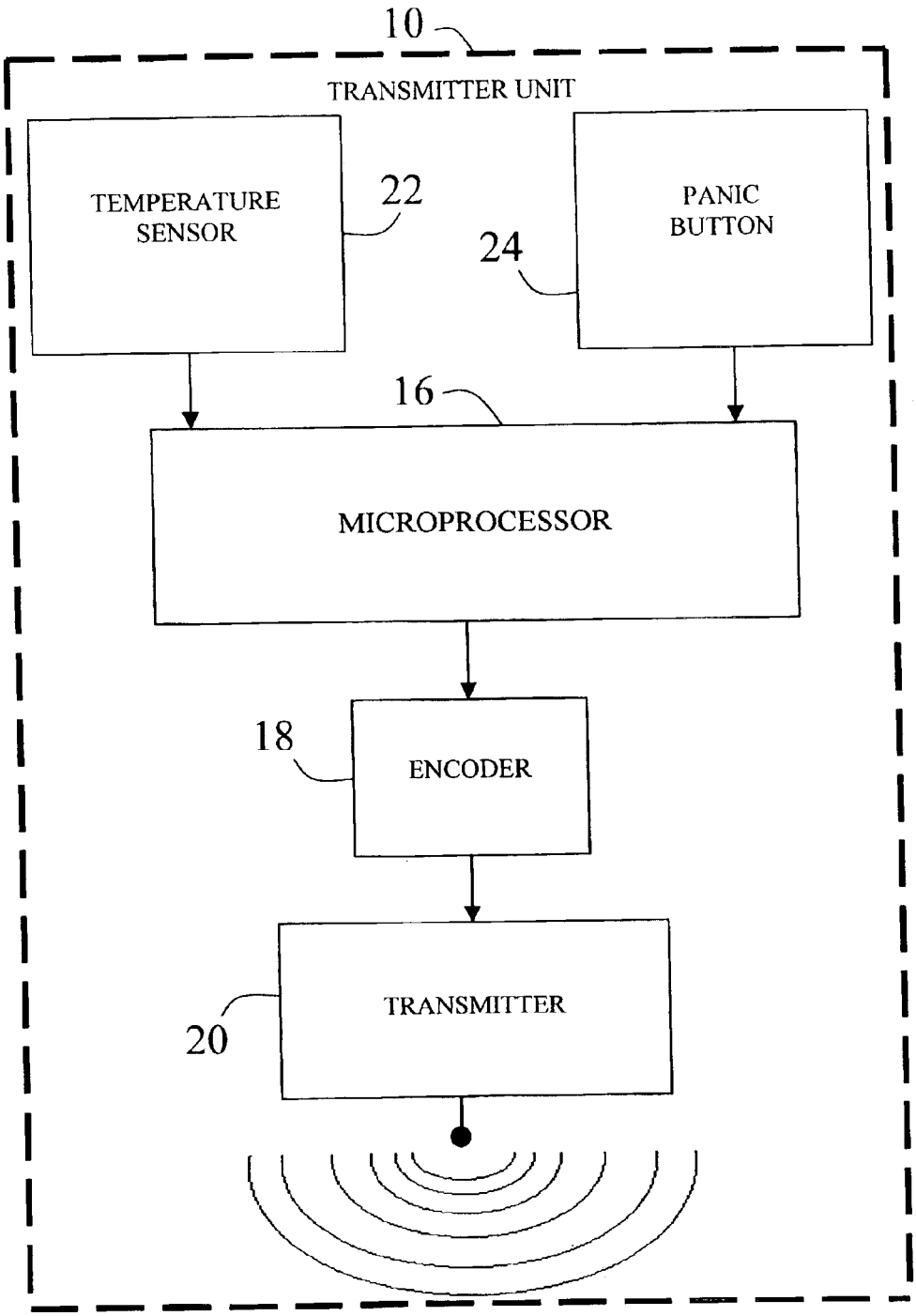
FIG. 2 is a block diagram of a transmitter unit of a method of determining location in accordance with the present invention.

With reference now to the drawings, and particularly to FIG. 1, there is shown a system block diagram of a method of determining location. The method of determining location includes at least one transmitter unit 10, at least three receiver units 12 and a central processing unit (CPU) 14. A single transmitter unit 10 is attached to each individual in a structure. With reference to FIG. 2, each transmitter unit 10 preferably includes a microprocessor 16, an encoder 18, and a transmitter 20. The microprocessor 16 sends temperature and possibly other data to the encoder 18. The encoder 18 packetizes temperature and possibly other data for transmission The transmitter 20 receives the packetized data from an output of the encoder 18. The transmitter 20 combines the packetized data with an RF signal to create a packetized signal. The frequency of the RF signal is different for each individual who has a transmitter unit 10. The packetized signal is transmitted by the transmitter 20. However, the transmitter unit 10 should include the possible use of other transmitter technologies. Temperature adjacent an individual may be monitored using a temperature sensor 22. The microprocessor 16 inputs the temperature from the temperature sensor 22 and outputs temperature data to the encoder 18. The microprocessor 16 may be programmed to activate the transmitter 20 in at least three different ways. First, the transmitter 20 may continuously transmit temperature and other data. Second, the transmitter 20 may periodically transmit temperature and other data. For example, the transmission occurs every 3 seconds. Third, the transmitter 20 may transmit temperature and other data when the temperature drops out of a temperature range. The microprocessor 16 compares the temperature with a high and low value of temperature range. If the temperature is outside of the high and low values, the transmitter 20 is activated. The temperature values in the range are preferably inputed into each transmitter unit 10 with a transmitter programming cradle 23. A panic button 24 may be connected to the microprocessor 16. If the panic button 24 is depressed, an emergency transmission is added to the temperature data. The emergency transmission is forwarded to the CPU 14 and the CPU 14 executes some action to make contact for assistance. A transmitter recharging cradle 26 may be used to recharge batteries in the transmitter unit 10.

Figure 3:
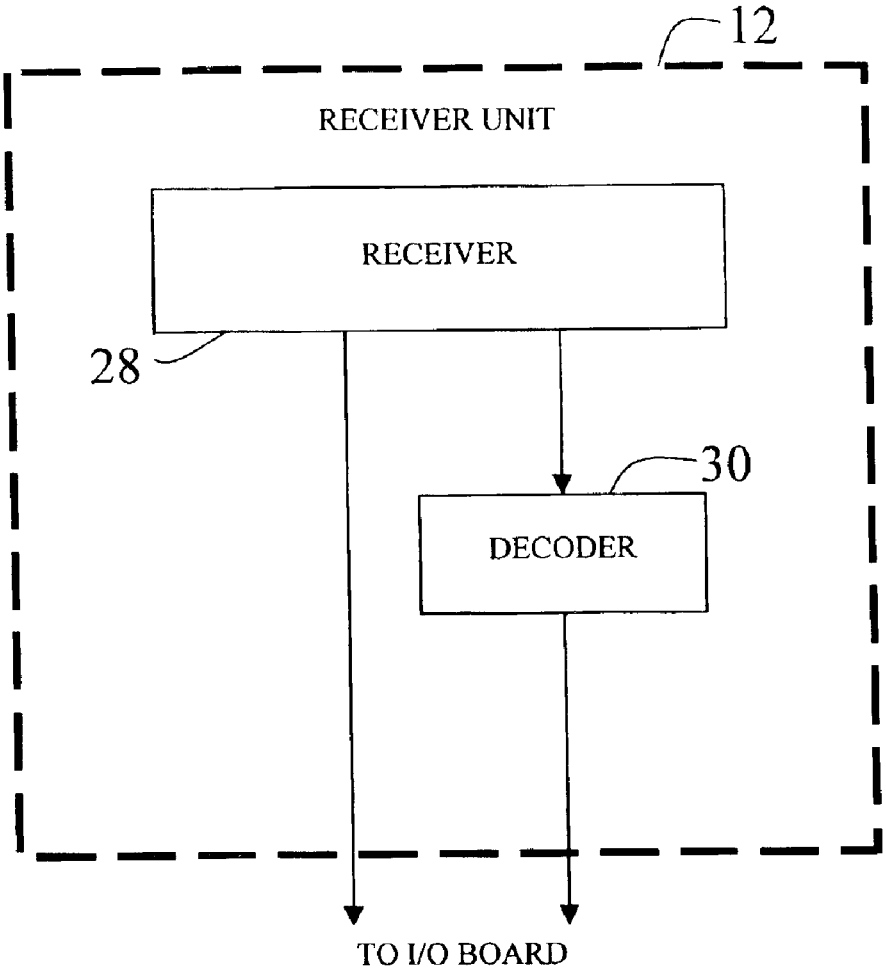
FIG. 3 is a block diagram of a receiver unit of a method of determining location in accordance with the present invention.

The at least three receiver units 12 are preferably arranged on each floor of the structure in a triangular configuration. The at least three receiver units 12 are required for each transmitter unit 10. Each person who has a transmitter unit 10 will transmit on a different frequency. Each receiver unit 12 is only capable of receiving a packetized signal from a single transmitter unit 10. With reference to FIG. 3, each receiver unit 12 includes a receiver 28. The receiver 28 receives the packetized signal from the transmitter 20, outputs a received strength signal and strips the packetized data from the RF signal.

It is preferable that an operational program have the ability to be calibrated to the correct position of an individual. Electro-magnetic interference contained within the structure will change the magnitude of the packetized signal. Therefore, it is advisable that the operational program learn and store signal strength values for each area of the structure. If temperature adjacent an individual is monitored, a decoder 30 is connected to the receiver 28. The decoder 30 unpacketizes the temperature and other possible data and outputs the temperature data to the I/O board.

The CPU 14 preferably includes a controller 32, at least one input device 34 and an input/output board (I/O board) 36. The controller 32 is preferably a computer, but other microprocessor or microcontroller based devices may also be used. The at least one input device 34 is preferably a keyboard and/or a mouse. The I/O board 36 receives data from the at least three receivers units 12. The I/O board 36 includes a plurality of analog-to-digital converters (A/D converters) and data buffering. The received signal strength outputs from the at least three receivers units 12 are converted from analog signals into digital received strength signals by the plurality of A/D converters. The digital received strength signals, the temperature and possible other data are buffered by the I/O board 36. The I/O board 36 is connected to the input pins of the controller 32 and the output pins of the controller 32 are preferably connected to the I/O board 36. The. I/O board 36 outputs control signals to control the operation of a furnace, air conditioner, and motorized dampers in vents and ducts in block 37. The controller 32 may be programmed to open and close motorized drapes or to operate lighting according to a time schedule. The controller 32 may also be used to turn on audio or video for a specific individual.

Figure 4:
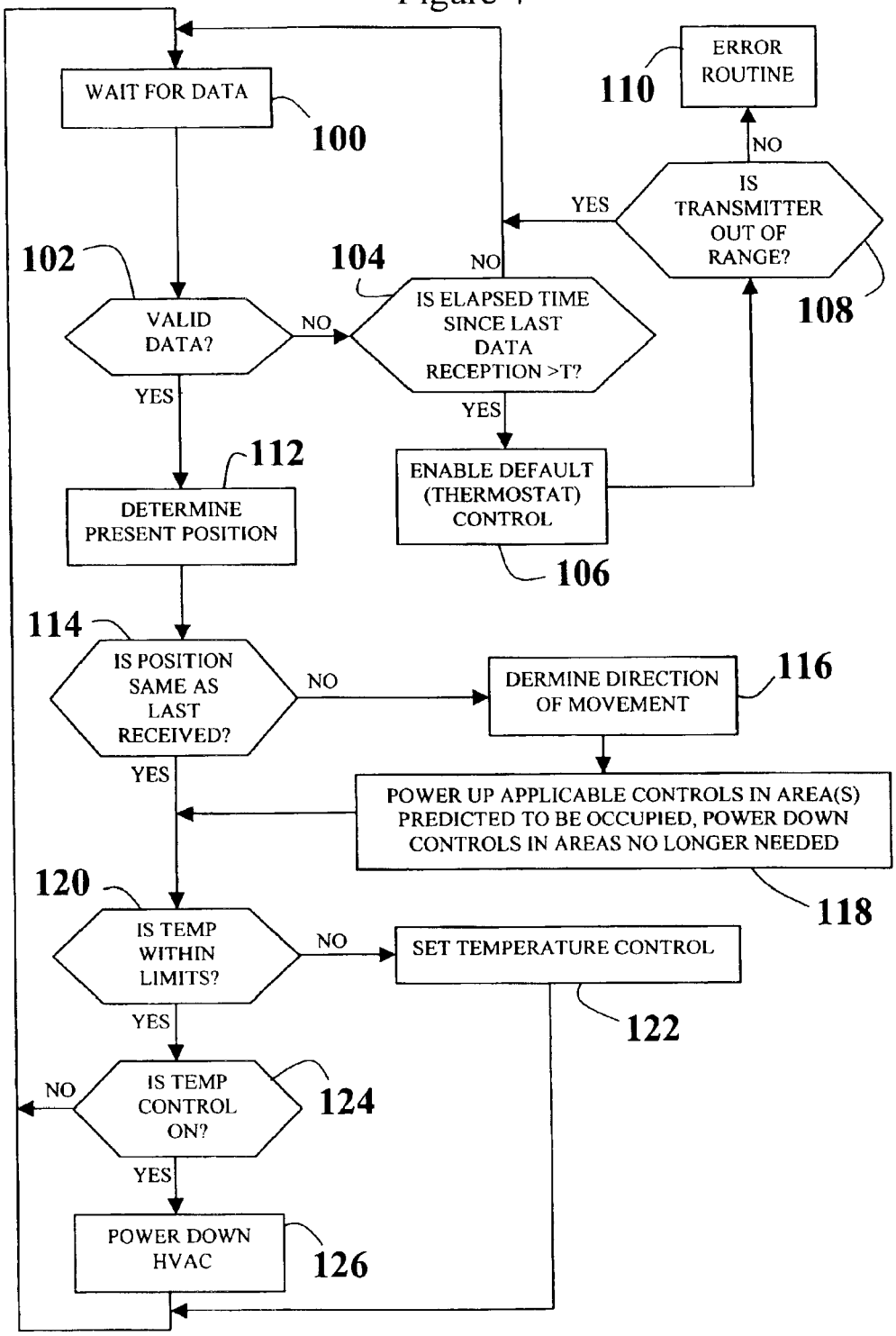
FIG. 4 is a flow chart of an operational program of a method of determining location in accordance with the present invention.

With reference to FIG. 4, the operational program in the controller 32 preferably operates the system in the following manner. The operational program waits for data input from the I/O board 36 in process block 100. The data input from the I/O board 36 is checked for validity in decision block 102. If valid data was not received, then the elapsed time since the last packet of data is compared to the data transmitting interval in decision block 104. The test in decision block 104 is used if a periodic transmission method is utilized. For example the transmission interval T is every 3 seconds. If the transmission interval has not passed, then the operational program would return to process block 100 to again wait for data. If the elapsed time since the last data transmission is greater than transmission interval T, the program would return control of a temperature control system to a standard thermostat control in process block 106.

There are at least two reasons why data has not been received in the expected amount of time. First, the individual wearing the transmitter unit 10 has left the structure. If the individual has left the structure, the system is able to track the individual's movements in process block 108. If the individual was the last to leave the structure or was the only one in the structure, a house alarm routine in the operational program is capable of arming the alarm system. The operational program is preferably capable of setting other control functions, such as temperature, lighting and window shades. The operational program will return to process block 100 and wait for data or someone to return to the structure. Second, if the transmitter is not out of range, the operational program would enter an error routine in process block 110, because it is known that there is no valid data. The elapsed time since last data received is excessive, and the individual is not out of range.

If valid data has been received in process block 102, the present position of the individual is calculated from that data in process block 112. The received strength signals from each receiver unit 12 are used to determine the location of the individual in the structure through triangulation. If the present position is not the same as the last known position in decision block 114, the direction of movement is determined in process block 116. Devices (such as lighting, audio, video and security) adjacent the individual are activated to meet the needs of the individual, while devices in other areas of the structure are set to a nonoccupied state in process block 118.

Figure 5:
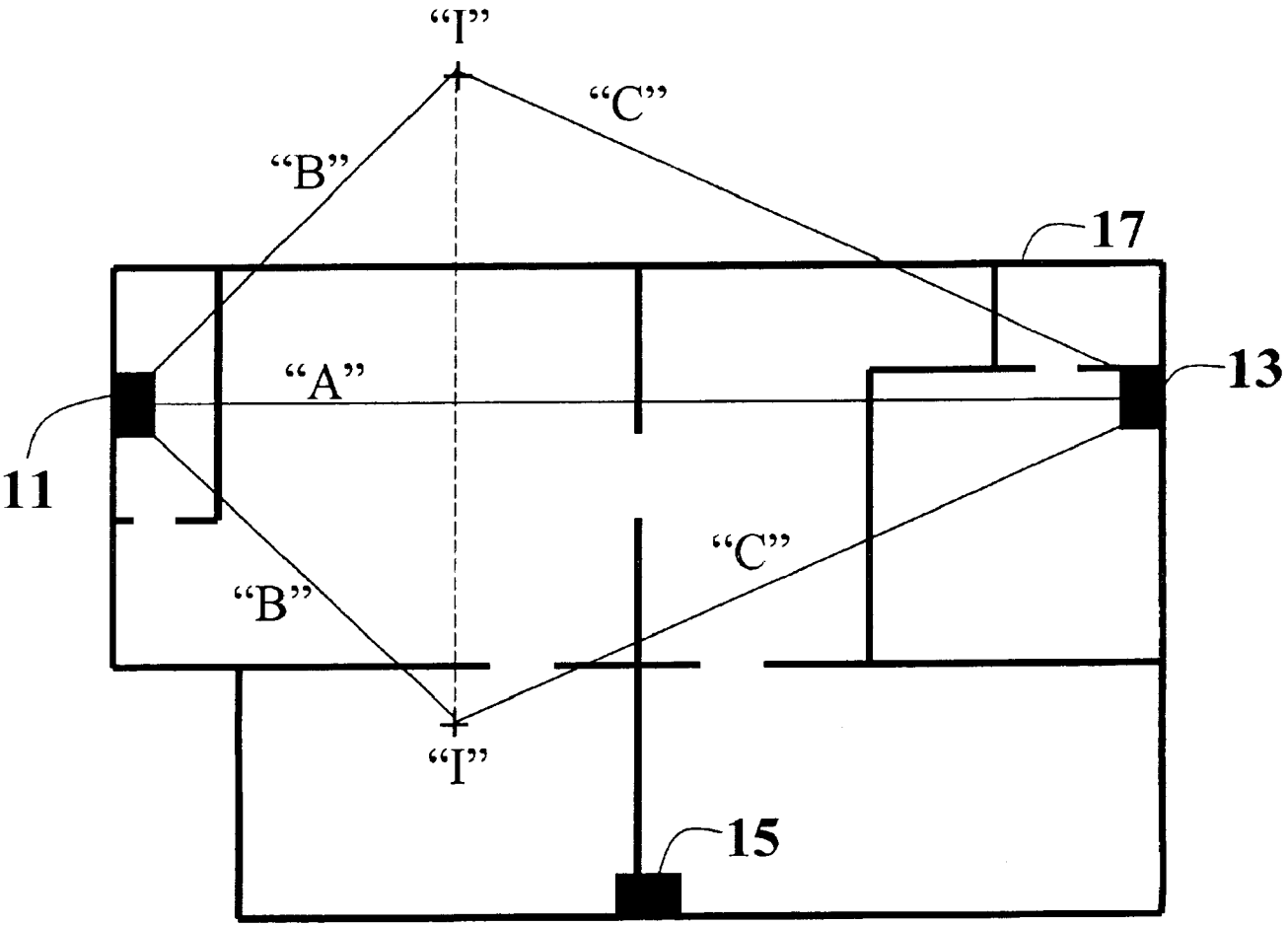
FIG. 5 is a floor plan of a structure having three receiver units in accordance with the present invention.

FIG. 5 shows a first receiver unit 11, a second receiver unit 13 and a third receiver unit 15 disposed in a structure 17. One method of triangulating the location of an individual is through the use of trigonometry. Trigonometry is used to calculate the x-y coordinates of the individual. However, other methods of triangulation may also be used. A distance between the first receiver unit 11 and the second receiver unit 13 is used as a first leg "A" of a triangle. A distance from a receiver unit to an individual is calculated using the magnitude of each packetized signal received by each receiver unit. The distance between the first receiver unit 11 and an individual "I", becomes a second leg "B" of the triangle. The distance between a second receiver unit 13 and the individual "I", becomes a third leg "C" of the triangle. However, the individual "I" could be located in one of two positions, therefore two possible triangles are created. The distance between the third receiver unit 15 and the individual "I" will determine the actual location of the individual "I".

The system is preferably capable of controlling other devices in the structure. For example, if lighting, audio and video are controllable; the preferred lighting, audio and video for that particular individual can be set in the exact area(s) of the structure that the individual is about to enter or has entered. Different preferences for each individual can be entered into the controller 32 through the at least one input device 34. Default settings (such as temperature) are activated when more than one individual is in the same area of the structure. Further, default settings exist for temperature, lighting, audio and other devices in nonoccupied areas of the structure.

If the position of the individual remains the same, the temperature preference of that individual for the particular area is compared to a database of individual temperature preferences in decision block 120. If the temperature is not within the range programmed in the transmitter unit 10; the temperature control is activated in process block 122. An individual may have multiple preferences for different areas in the structure. The individual may also have preferences for each area at different times of the day. The temperature may be modified by opening and closing motorized dampers in either individual vents in the structure or in ducts that control airflow to a larger area. After temperature control has been set, the operational program returns to process block 100.

If the temperature is within acceptable limits for a particular individual, it must be determined whether the heating, ventilation and air conditioning (HVAC) is powered in decision block 124. If the temperature control is on, then power down the HVAC in process block 126; the operational program returns to process block 100. If the HVAC is off, the operational program returns to process block 100. The operations program waits for more data in process block 100. An individual is defined as a person, animal, object or any other appropriate entity.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of determining the position of at least one individual in a structure, comprising the steps of:

attaching a transmitter to each individual in the structure;

providing at least three receivers to receive a signal from each said transmitter, each one of said at least three receivers outputing a received strength signal to produce at least three received strength signals;

storing a plurality of signal strength values for each area of the structure to compensate for electro-magnetic interference, adjusting said at least three received strength signals taken in a particular area with one of said plurality of signal strength values; and calculating said at least three received strength signals to determine the location of the at least one individual in the structure.

2. The method of determining the position of at least one individual in a structure of claim 1, further comprising the step of:

combining temperature data with said signal to produce a data signal.

3. The method of determining the position of at least one individual in a structure of claim 2, further comprising the step of:

receiving said data signal from said transmitter, each one of said at least three receivers outputing said temperature data and said received signal strength to a controller.

4. The method of determining the position of at least one individual in a structure of claim 3, further comprising the step of:

unpacketizing said temperature data before outputing to said controller.

5. The method of determining the position of at least one individual in a structure of claim 3, further comprising the step of:

providing an input device for programming said controller, said programming capable of controlling lighting, audio, video or security.

6. The method of determining the position of at least one individual in a structure of claim 3, further comprising the step of:

buffering data input into said controller with an I/O board.

7. The method of determining the position of at least one individual in a structure of claim 2, further comprising the step of:

packetizing said temperature data before inputing thereof into said transmitter.

8. The method of determining the position of at least one individual in a structure of claim 2, further comprising the steps of:

examining temperature data to determine if the temperature is out of a predetermined range, activating said transmitter if said temperature is out of the predetermined range.

9. The method of determining the position of at least one individual in a structure of claim 8, further comprising the step of:

controlling HVAC with said temperature data.

10. The method of determining the position of at least one individual in a structure comprising the steps of:

attaching a transmitter unit to each individual in the structure;

providing at least three receiver units to receive a signal from each said transmitter unit, each one of said at least three receivers outputing a received strength signal to produce at least three received strength signals;

storing a plurality of signal strength values for each area of the structure to compensate for electro-magnetic interference, adjusting said at least three received strength signals taken in a particular area with one of said plurality of signal strength values; and calculating said at least three received strength signals with a controller to determine the location of the at least one individual in the structure.

11. The method of determining the position of at least one individual in a structure of claim 10, further comprising the step of:

providing a transmitter unit with a temperature sensor, combining temperature data from said temperature sensor with said signal to produce a data signal.

12. The method of determining the position of at least one individual in a structure of claim 11, further comprising the step of:

receiving said data signal from said transmitter, each one of said at least three receivers outputing said temperature data and said received signal strength to said controller.

13. The method of determining the position of at least one individual in a structure of claim 12, further comprising the step of:

unpacketizing said temperature data before outputing to said controller.

14. The method of determining the position of at least one individual in a structure of claim 11, further comprising the step of:

packetizing said temperature data before combining thereof into said data signal.

15. The method of determining the position of at least one individual in a structure of claim 11, further comprising the step of:

examining temperature data to determine if the temperature is out of a predetermined range, activating said transmitter if said temperature is out of the predetermined range.

16. The method of determining the position of at least one individual in a structure of claim 15, further comprising the step of:

controlling HVAC with said temperature data.

17. The method of determining the position of at least one individual in a structure of claim 10, further comprising the step of:

providing an input device for programming said controller, said programming capable of controlling lighting, audio, video or security.

18. The method of determining the position of at least one individual in a structure of claim 10, further comprising the step of:

buffering data input into said controller with an I/O board.

19. The method of determining the position of at least one individual in a structure of claim 10, further comprising the step of:

providing a programming cradle for programming a specific temperature range into a transmitter unit.

* * * * *